US012543916B2

(12) United States Patent
Koepke

(10) Patent No.: US 12,543,916 B2
(45) Date of Patent: Feb. 10, 2026

(54) ADJUSTABLE CONDUIT IN DISHWASHER APPLIANCES

(71) Applicant: Haier US Appliance Solutions, Inc., Wilmington, DE (US)

(72) Inventor: Steven Chadwick Koepke, LaGrange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 185 days.

(21) Appl. No.: 18/532,460

(22) Filed: Dec. 7, 2023

(65) Prior Publication Data

US 2025/0185874 A1 Jun. 12, 2025

(51) Int. Cl.
*A47L 15/42* (2006.01)
*A47L 15/50* (2006.01)

(52) U.S. Cl.
CPC ..... *A47L 15/4221* (2013.01); *A47L 15/4219* (2013.01); *A47L 15/4246* (2013.01); *A47L 15/4278* (2013.01); *A47L 15/508* (2013.01)

(58) Field of Classification Search
None
See application file for complete search history.

(56) References Cited

U.S. PATENT DOCUMENTS

| | | | |
|---|---|---|---|
| 10,264,946 | B2 | 4/2019 | Choi et al. |
| 11,278,178 | B2 | 3/2022 | Hong et al. |
| 2020/0337519 | A1 | 10/2020 | Büsing et al. |

FOREIGN PATENT DOCUMENTS

| | | | |
|---|---|---|---|
| CN | 218419786 | U | 2/2023 |

*Primary Examiner* — Levon J Shahinian
(74) *Attorney, Agent, or Firm* — Dority & Manning, P.A.

(57) ABSTRACT

A dishwasher appliance includes a tub comprising a top wall and a back wall. The tub defines a wash chamber. The dishwasher appliance includes a diverter assembly at a bottom of the wash chamber, an upper spray assembly positioned proximate the top wall to the tub and configured to direct wash fluid downward into the wash chamber, and a wash conduit in the wash chamber. The wash conduit includes a supply channel extending between the diverter assembly and the upper spray assembly. The wash conduit further includes a retainer portion on a top side of the wash conduit. The retainer portion is configured to engage a clip on the top wall of the tub in order to position the wash conduit in contact with an inner side of the back wall of the tub.

20 Claims, 8 Drawing Sheets

ADJUSTABLE CONDUIT IN DISHWASHER APPLIANCES

FIELD OF THE INVENTION

The present subject matter relates generally to wash conduits in dishwasher appliances, particularly the installation of the wash conduit.

BACKGROUND OF THE INVENTION

Dishwasher appliances generally include rack assemblies for positioning various articles for cleaning within a wash chamber. One or more devices, such as nozzles or spray assemblies, may be included at various locations relative to the rack assemblies for purposes of delivering fluids as part of the cleaning process. During the cleaning cycle, the rack assemblies can support and position the articles while also having openings that allow fluid to pass through to the articles. Factors such as the velocity of the fluid, orientation of the fluid spray or stream relative to the articles, the shape and density of the articles in the rack assemblies, and other factors, can impact the effectiveness of the cleaning cycle.

One or more rack assemblies may be used in dishwasher appliances for user convenience. Multiple rack assemblies on multiple levels within dishwasher appliances may allow users to place articles of differing heights and sizes in optimal positions to allow for proper cleaning of the articles. Some dishwasher appliances may include one or more baskets which may also be provided for holding articles, particularly smaller or for more narrow articles, such as silverware. Additionally, the user may have the option of, e.g., placing articles, such as silverware, within a basket on a lower rack assembly or placing the silverware directly (without the basket) onto an upper rack assembly specially configured for the receipt of such articles.

The positioning of articles within a dishwasher appliance can affect the fluid dynamics to which the articles are exposed during the cleaning process. For example, articles placed in a lower rack assembly may be subjected to different spray assemblies with different spray patterns, velocities, and spray duration than articles placed in a higher rack assembly. As dishwasher appliances have begun including more racks, space and positioning of dishwashing components inside of the dishwasher is important to ensure proper washing.

BRIEF DESCRIPTION OF THE INVENTION

Aspects and advantages of the invention will be set forth in part in the following description, or may be apparent from the description, or may be learned through practice of the invention.

In one example embodiment, a dishwasher appliance includes a tub comprising a top wall and a back wall. The tub defines a wash chamber. The dishwasher appliance includes a diverter assembly at a bottom of the wash chamber, an upper spray assembly positioned proximate the top wall to the tub and configured to direct wash fluid downward into the wash chamber, and a wash conduit in the wash chamber. The wash conduit includes a first supply channel that includes a first supply channel inlet. The first supply channel extends between the diverter assembly and a wash conduit outlet. The wash conduit also includes a second supply channel that includes a second supply channel inlet. The second supply channel extends between the diverter assembly and the upper spray assembly. The wash conduit further includes a retainer portion on a top side of the wash conduit. The retainer portion is configured to engage a clip on an inner side of the top wall of the tub in order to position the wash conduit in contact with an inner side of the back wall of the tub. The upper spray assembly coupled to an upper outlet of the wash conduit.

In another example embodiment, a dishwasher appliance includes a tub comprising a top wall and a back wall. The tub defines a wash chamber. The dishwasher appliance includes a diverter assembly at a bottom of the wash chamber, an upper spray assembly positioned proximate the top wall to the tub and configured to direct wash fluid downward into the wash chamber, and a wash conduit in the wash chamber. The wash conduit includes a supply channel extending between the diverter assembly and the upper spray assembly. The wash conduit further includes a retainer portion on a top side of the wash conduit. The retainer portion is configured to engage a clip on the top wall of the tub in order to position the wash conduit in contact with an inner side of the back wall of the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
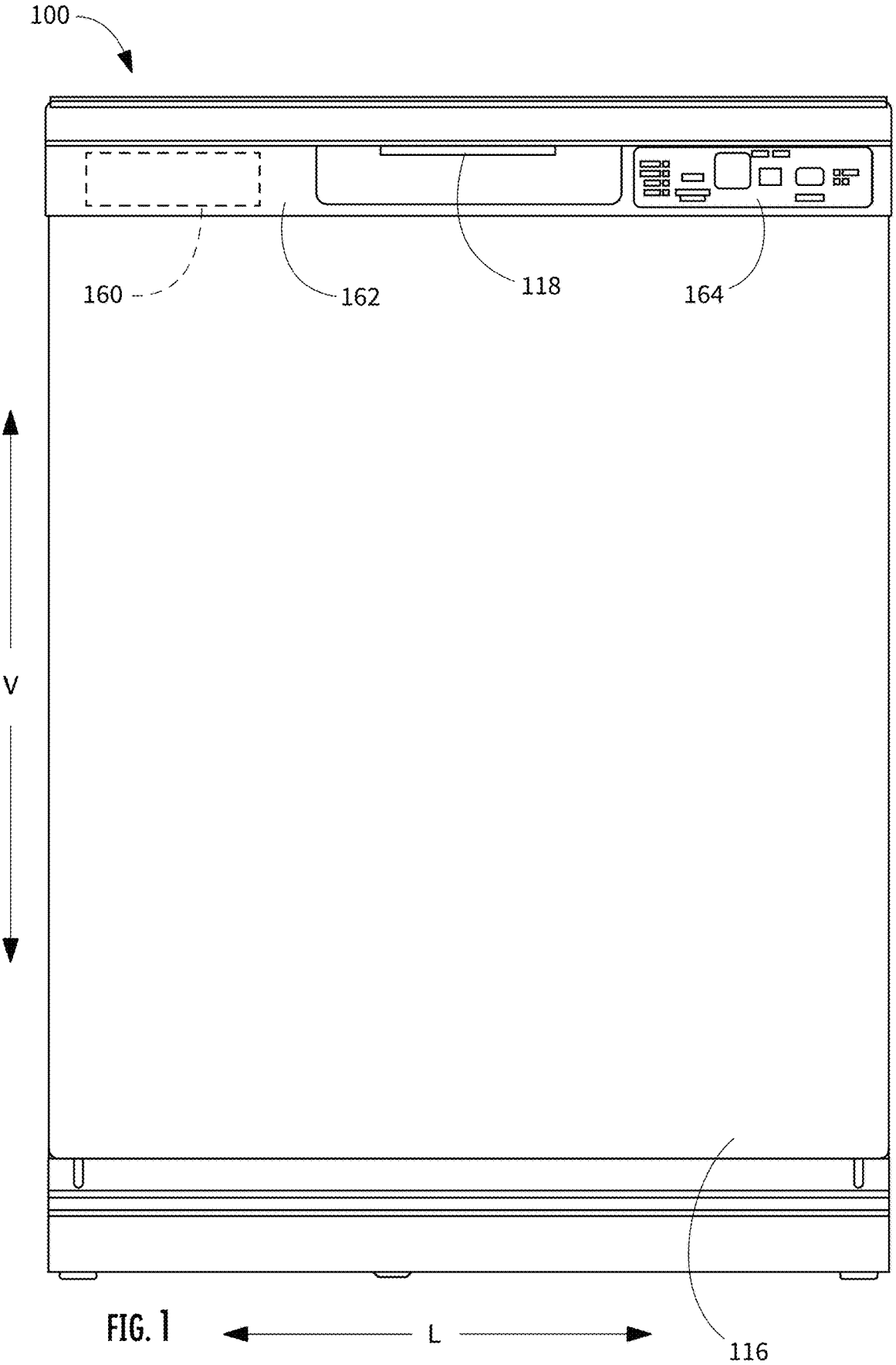
FIG. 1 provides a front view of an example embodiment of a dishwashing appliance of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid). Furthermore, as used herein, terms of approximation, such as "generally," "approximately," "substantially," or "about," refer to being within a ten percent (10%) margin of error. When used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
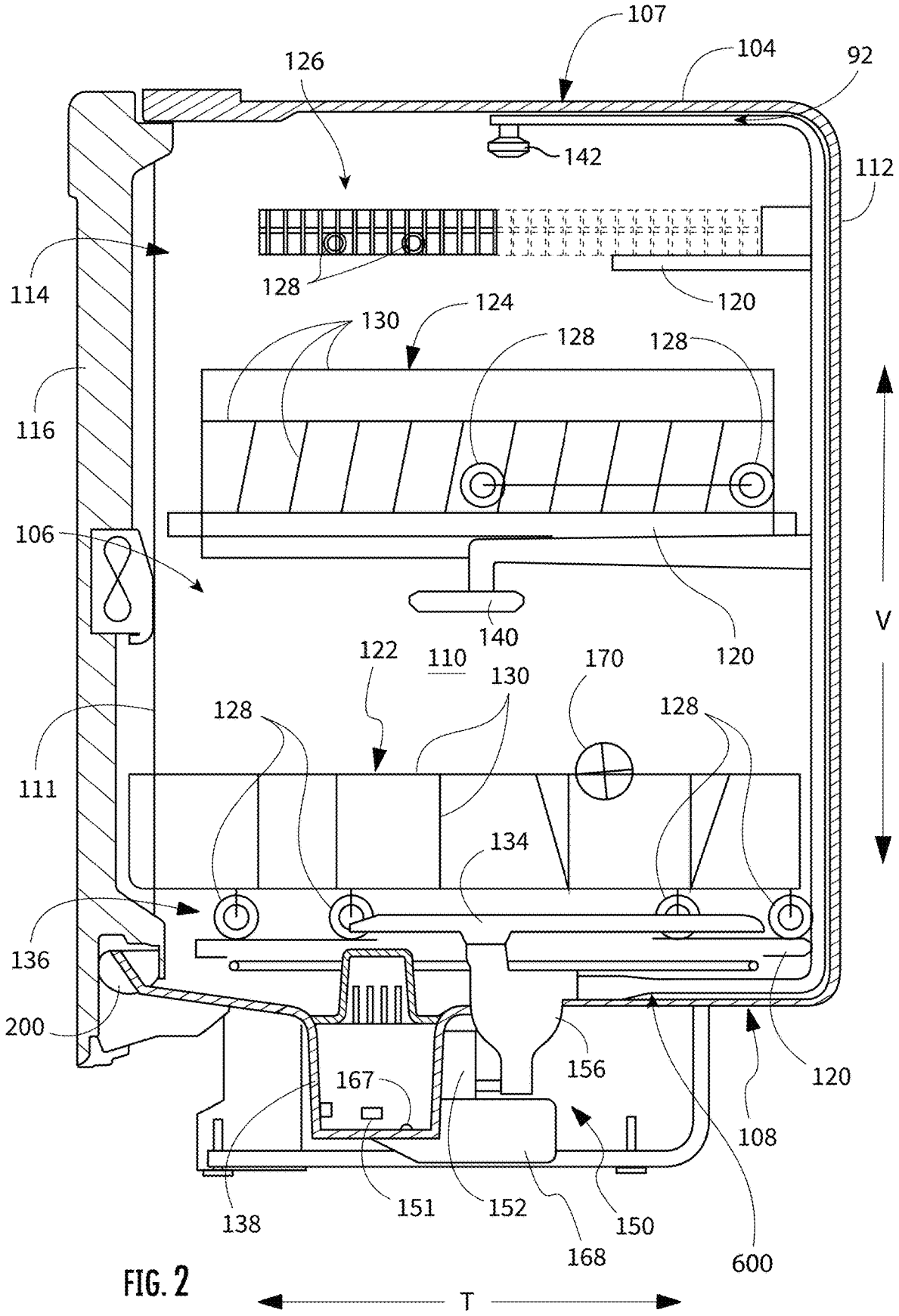
FIG. 2 provides a side, cross sectional view of the example dishwashing appliance of FIG. 1.

Turning now to the figures, FIGS. 1 and 2 depict an example dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Figure 3:
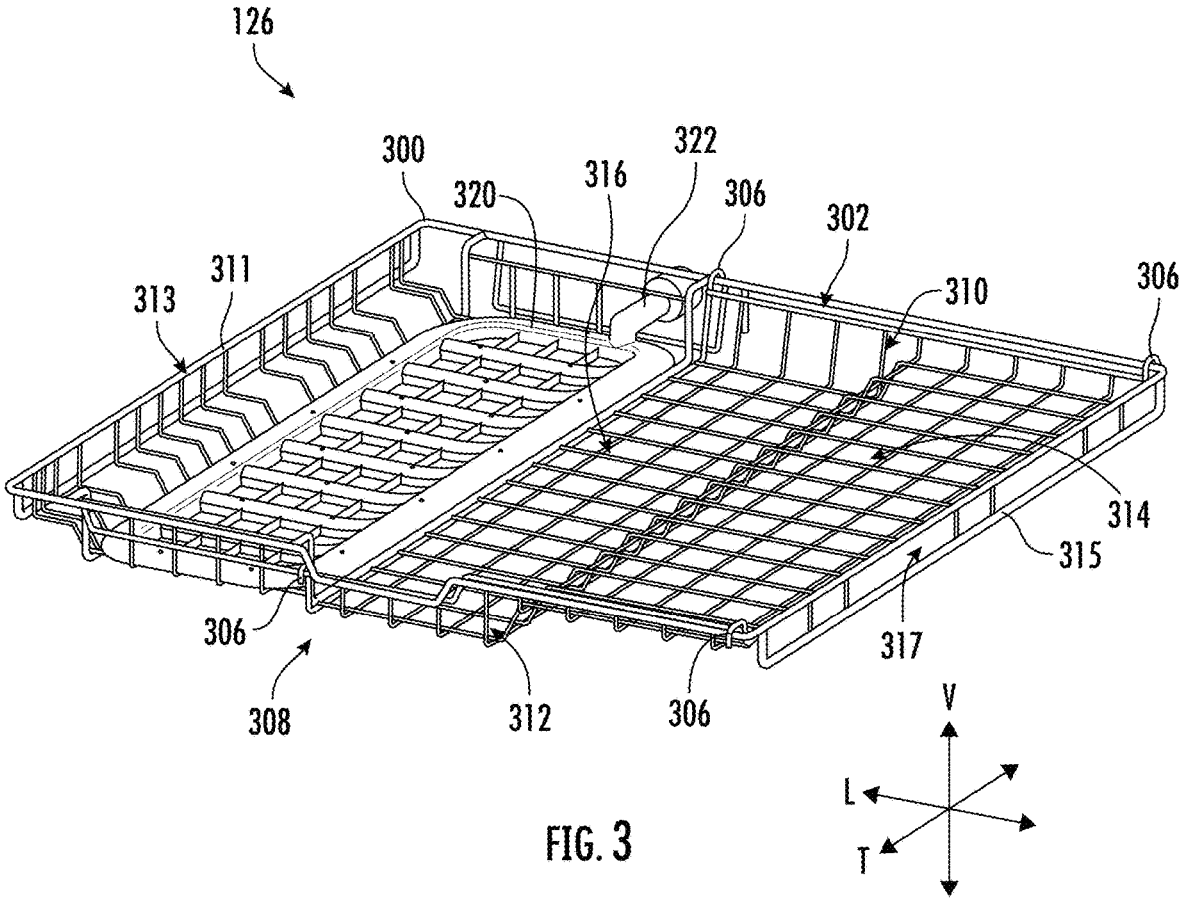
FIG. 3 provides a perspective view of an example embodiment of a rack of the dishwashing appliance of FIG. 1.

Dishwasher 100 includes a tub 104 that defines a wash chamber 106 therein. As shown in FIG. 3, tub 104 extends between a top wall 107 and a bottom wall 108 along the vertical direction V, between a pair of side walls 110 along the lateral direction L, and between a front side 111 and a rear wall 112 along the transverse direction T.

Tub 104 includes a front opening 114 at the front side 111. In some embodiments, the dishwashing appliance 100 may also include a door 116 at the front opening 114. The door 116 may, for example, be coupled to the tub 104 by a hinge 200 at its bottom for movement between a normally closed vertical position (FIGS. 1 and 2), wherein the wash chamber 106 is sealed shut for washing operation, and a horizontal open position (not shown) for loading and unloading of articles from dishwasher 100. A door closure mechanism or assembly 118, e.g., a latch, may be provided to lock and unlock door 116 for accessing and sealing wash chamber 106.

At least one rack assembly is slidably positioned within wash chamber 106 and is configured for the receipt of articles for cleaning. For the example embodiment shown in FIG. 2, opposing tub sidewalls 110 accommodate a plurality of rack assemblies. More specifically, guide rails 120 may be mounted to side walls 110 for supporting a first rack assembly 122 (also referred to as a lower rack assembly 122), a middle rack assembly 124 (also referred to as a second rack assembly 124), and a third rack assembly 126 (also referred to as an upper rack assembly 126). As illustrated, upper rack assembly 126 is positioned at a top portion of wash chamber 106 above middle rack assembly 124, which is positioned above lower rack assembly 122 along the vertical direction V. Additional details regarding the upper rack assembly 126 will be provided herein. For this example embodiment, upper rack assembly 126 is supported on opposing sidewalls 110 by rails 120 but rails 120 could be supported on and attached to middle rack assembly 124 as well.

Generally, each rack assembly 122, 124, 126 may be adapted for movement between an extended loading position (not shown) in which the rack is substantially positioned outside the wash chamber 106, and a retracted position (shown in FIG. 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown). In this regard, rack assemblies 122, 124, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106.

In example embodiments, dishwasher 100 includes a lower spray arm assembly 134 disposed in a lower region 136 of wash chamber 106 and above a sump 138 so as to rotate in relatively close proximity to lower rack assembly 122. In this regard, lower spray arm assembly 134 may generally be configured for urging a flow of wash liquid up through lower rack assembly 122.

Moreover, a mid-level spray assembly 140 may be located in wash chamber 106 and may be located below and in close proximity to middle rack assembly 124. In this regard, mid-level spray arm assembly 140 may generally be configured for urging a flow of wash fluid up through middle rack assembly 124 and third rack assembly 126.

Additionally, in some embodiments, an upper spray assembly 142 may be located above upper or third rack assembly 126 along the vertical direction V, proximate top wall 107, e.g., upper spray assembly 142 may be any distance within two and a half centimeters from top wall 107 in the vertical direction V. In this manner, upper spray assembly 142 may be configured for urging and/or cascading a flow of wash fluid downward over rack assemblies 122, 124, and 126.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be mounted to sump 138 and in fluid communication with the sump 138 through a circulation outlet 151 from the sump 138.

When assembled, circulation pump 152 may be in fluid communication with an external water supply line (not shown) and sump 138. A water inlet valve (not shown) can be positioned between the external water supply line and circulation pump 152 (e.g., to selectively allow water to flow from the external water supply line to circulation pump 152). Additionally or alternatively, water inlet valve can be positioned between the external water supply line and sump 138 (e.g., to selectively allow water to flow from the external water supply line to sump 138). During use, water inlet valve may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In example embodiments, such as that shown in FIG. 2, a wash conduit 154 may extend from circulation pump 152, in contact with rear wall 112 of tub 104 along the vertical direction V to supply wash liquid throughout wash chamber 106.

As illustrated, wash conduit 154 may include a first supply channel 400 (FIG. 4) which supplies wash fluid to a third spray assembly 320 (FIG. 3), while a second supply channel 92 of wash conduit 154 is used to supply wash fluid to mid-level spray arm assembly 140 and upper spray assembly 142. A diverter assembly 156, positioned at bottom wall 108 of tub 104, may allow selection between spray assemblies 134, 140, 142, and 320 being supplied with wash fluid. However, it should be appreciated that in alternative embodiments, any other suitable plumbing configuration may be used to supply wash fluid throughout the various spray manifolds and assemblies described herein. For example, the wash conduit of the present example embodiment includes multiple supply channels, however alternative example embodiments may include any number of suitable channels, such as one or more, and the wash conduit of the present example embodiment would be understood to be described by way of example only.

Each spray assembly 134, 140, 142, 320 or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142, 320 may be motor-driven, or may operate using any other suitable drive mechanism. Spray manifolds and assemblies may also be stationary. Movement of the spray arm assemblies 134 and 140 and the spray from fixed manifolds like spray assemblies 142, 320 provides coverage of dishes, silverware, and other dishwasher contents and articles 94 to be cleaned with a washing spray. Other configurations of spray assemblies may be used as well. For example, dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber (not shown) for selectively distributing the wash fluid to the spray assemblies 134, 140, 142 and/or other spray manifolds or devices. For example, the diverter disk may have a plurality of apertures that are configured to align with one or more outlet ports (not shown) at the top of diverter chamber (not shown). In this manner, the diverter disk may be selectively rotated to provide wash fluid to the desired spray device.

Drainage of soiled wash liquid within sump 138 may by provided, for instance, by a drain pump 168 (e.g., during or as part of a drain phase). In particular, wash liquid may exit sump 138 through a drain outlet 167 and may flow through a drain conduit or directly to the drain pump 168. Thus, drain pump 168 is downstream of sump 138 and facilitates drainage of the soiled wash liquid by urging or pumping the wash liquid to a drain line external to dishwasher 100.

In some embodiments, a filter assembly may be provided, e.g., in the sump 138 and/or at a top entrance into the sump 138, e.g., to filter fluid to circulation assembly 150 and/or drain pump 168. Generally, the filter assembly removes soiled particles from the liquid that flows to the sump 138 from the wash chamber 106 during operation of dishwashing appliance 100. In example embodiments, the filter assembly may include both a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwasher appliance 100 is further equipped with a controller 160 (FIG. 2) to regulate operation of the dishwasher appliance 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 may be positioned in a variety of locations throughout dishwasher appliance 100. In the illustrated embodiment, controller 160 may be located within a control panel area 162 of door 116. In such an embodiment, input/output ("I/O") signals may be routed between the control system and various operational components of dishwasher appliance 100 along wiring harnesses that may be routed through the bottom of door 116. Typically, controller 160 includes a user interface panel/controls 164 (FIG. 1) through which a user may select various operational features and modes and monitor progress of the dishwasher appliance 100. In one embodiment, user interface 164 may represent a general purpose I/O ("GPIO") device or functional block. In one embodiment, user interface 164 may include input components, such as one or more of a variety of electrical, mechanical, or electro-mechanical input devices including rotary dials, push buttons, and touch pads. User interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher appliance 100. The example embodiment depicted in FIGS. 1 and 2 is for illustrative purposes only. For example, different locations may be provided for user interface 164, different configurations, including providing one or more rack assemblies 122, 124, 126 and one or more spray assemblies 134, 140, 142, and 320 to dishwasher appliance 100 may be used, different configurations may be provided for rack assemblies 122, 124, 126, different spray assemblies 134, 140, 142, and 320 and spray manifold configurations may be used, and other differences may be applied while remaining within the scope of the present subject matter.

Shown in FIG. 3, the perimeter of third rack assembly 126 may be defined by a wire framework 300. Wire framework 300 may include a floor 308 formed in combination with the floor portion of wire insert 302. Wire insert 302 may include at least two (2) of a hook 306, or the like, for removably coupling wire insert 302 to wire framework 300. The present example embodiment includes four (4) hooks 306. Wire insert 302 may be defined in the transverse direction T, between a first boundary wall 310 and a second boundary wall 312, whereupon hooks 306 may be positioned. In FIG. 3, wire insert 302 is shown coupled to wire framework 300 via hooks 306. A lower floor portion 316 of wire insert 302 may generally be configured to move beneath a third spray assembly 320. For example, wire insert 302 may be configured to translate within wire framework 300 and position lower floor portion 316 beneath, in the vertical direction V, third spray assembly 320. Wire insert 302 may include an upper floor portion 314 and the lower floor portion 316. The upper floor portion 314 and the lower floor portion 316 may be positioned at different heights with respect to the vertical direction V such that different size articles for washing may be placed upon wire insert 302. Lower floor portion 316 may be configured to interface, e.g., minimal gap, with floor 308 when wire insert 302 is inserted in wire framework 300. Thus, e.g., floor 308 may be nested against wire insert 302 when wire insert 302 is inserted in wire framework 300. Moreover, lower floor portion 316 may be positioned generally coplanar with floor 308 such that lower floor portion 316 and floor 308 may collectively form a portion of the floor of third rack assembly 126.

Figure 4:
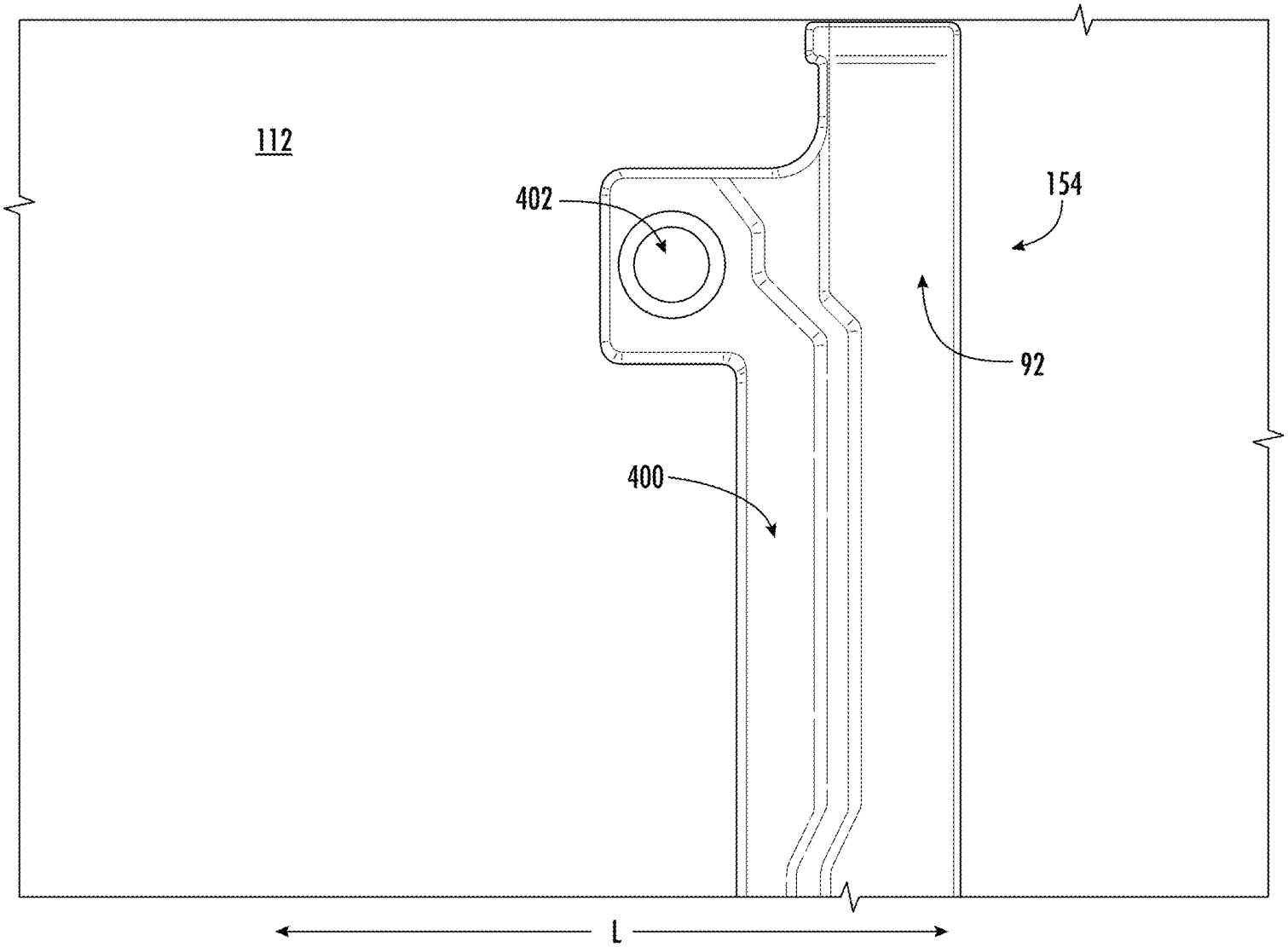
FIG. 4 provides a schematic view of an example wash conduit according to example embodiments of the present disclosure.
Figure 5:
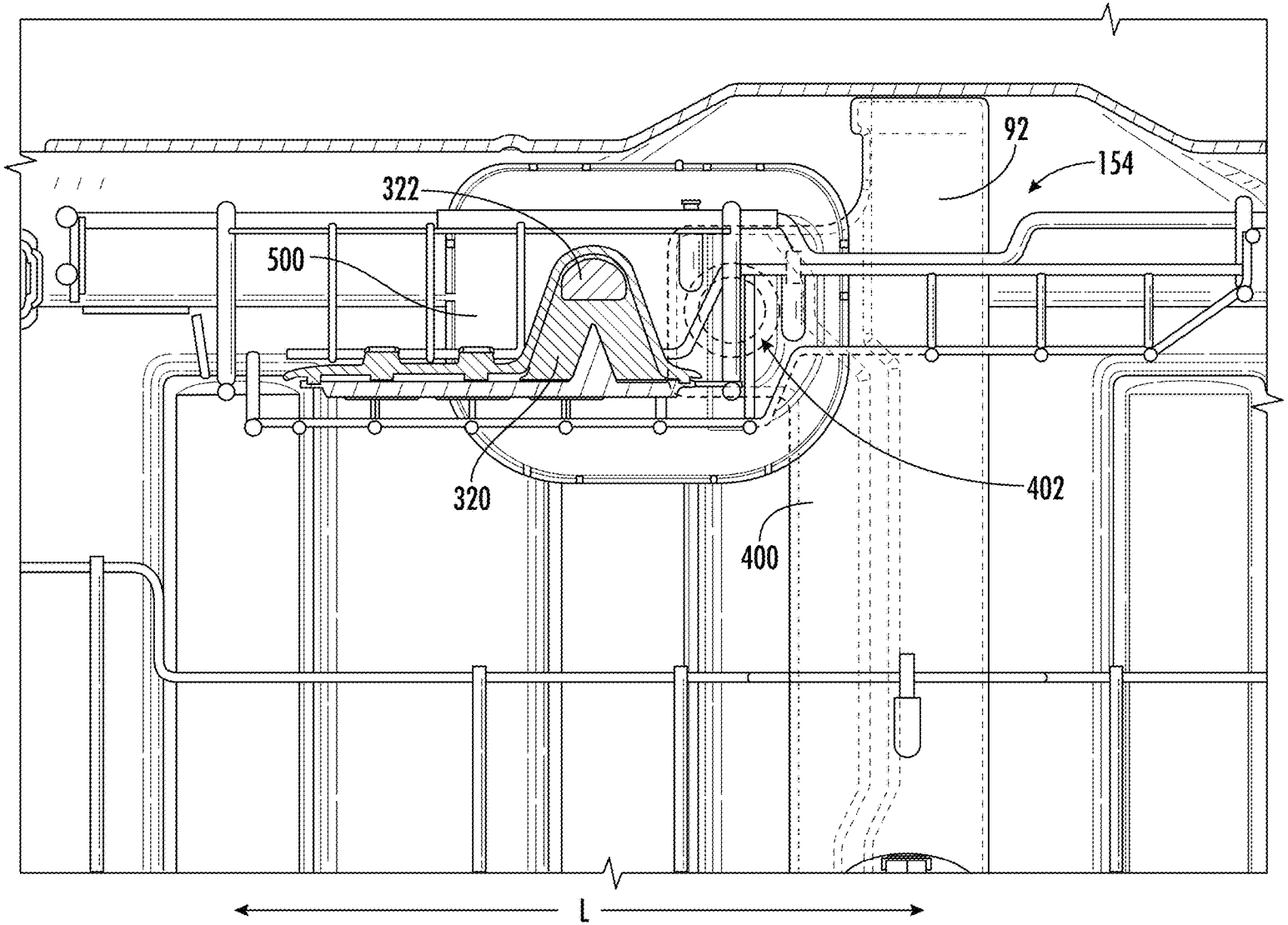
FIG. 5 provides a view of the third rack assembly of FIG. 3 docking with a wash conduit according to example embodiments of the present disclosure.

Shown in FIGS. 4 and 5, in general, the wash conduit 154 may extend along back wall 112 of tub 104 along the vertical direction V to supply wash fluid throughout wash chamber 106. One channel of wash conduit 154 may be first supply channel 400. Another channel of wash conduit 154 may be second supply channel 92, which may supply wash fluid to upper spray assembly 142. Generally, first supply channel 400 may distribute wash fluid to a first wash conduit outlet 402, e.g., to third spray assembly 320. Third spray assembly 320 may generally include an inlet nozzle 322 generally configured for connecting with wash conduit 154. In general, wash conduit 154 may include a conduit connector 500 to interface with inlet nozzle 322. Particularly, as shown in FIG. 5 for example, inlet nozzle 322 may dock within conduit connector 500 such that wash conduit 154 may supply third spray assembly 320 with wash water through first wash conduit outlet 402. Particularly, conduit connector 500 may be connectable between inlet nozzle 322 of third spray assembly 320 and first wash conduit outlet 402 such that wash fluid may flow into third spray assembly 320.

Figure 6:
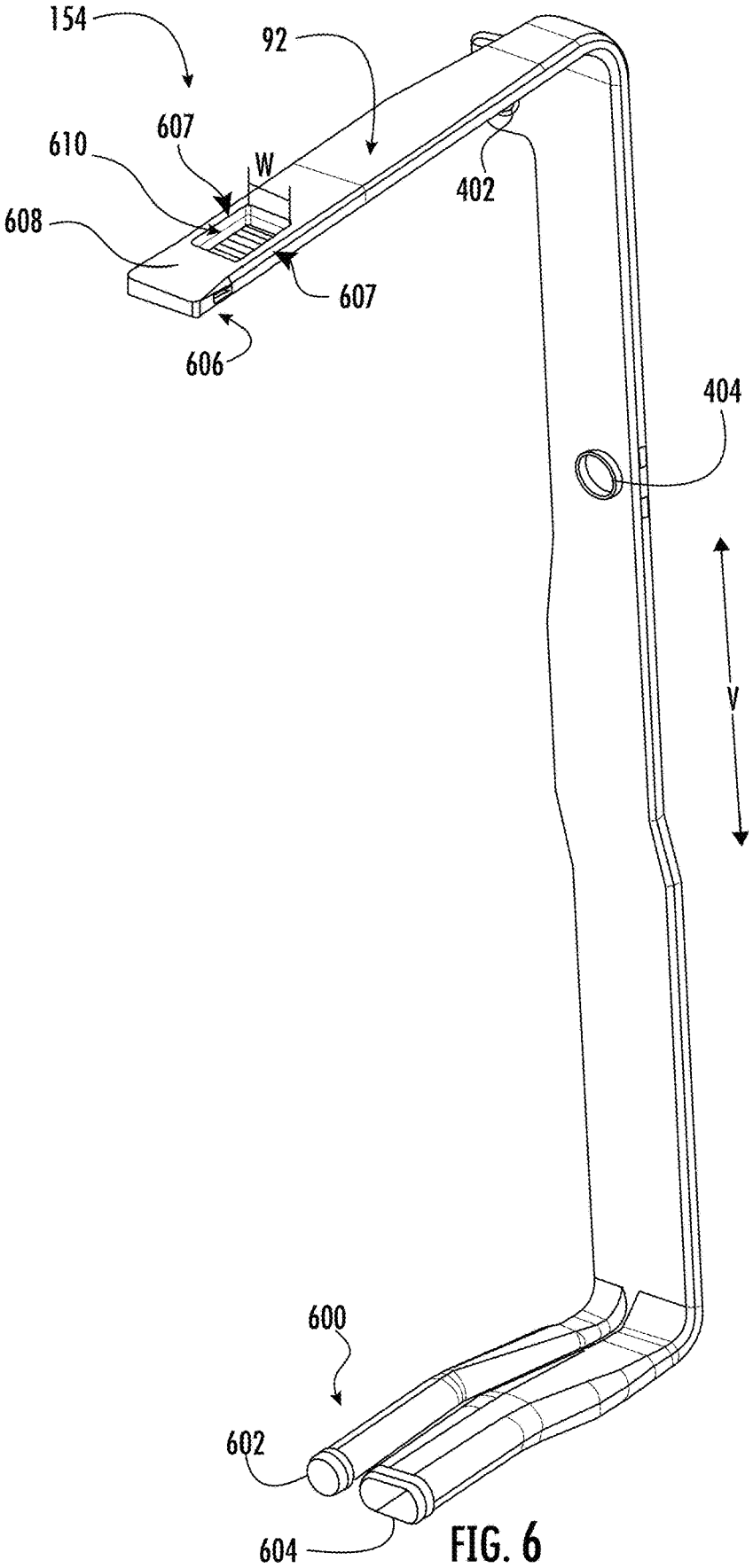
FIG. 6 provides a perspective view of an example wash conduit according to example embodiments of the present disclosure.
Figure 7:
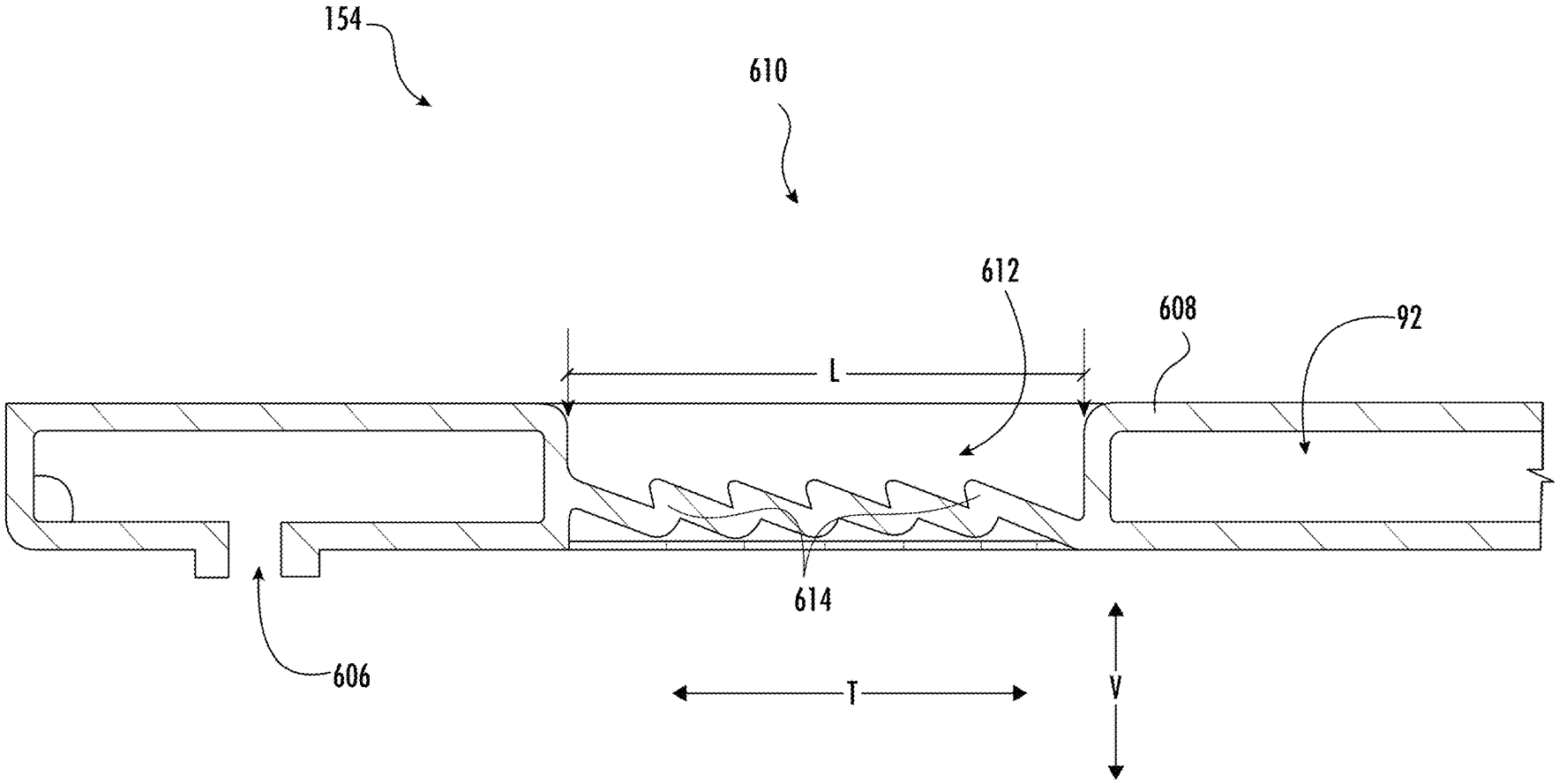
FIG. 7 provides a side section view of a retainer portion of the wash conduit of FIG. 6 according to example embodiments of the present disclosure.
Figure 8:
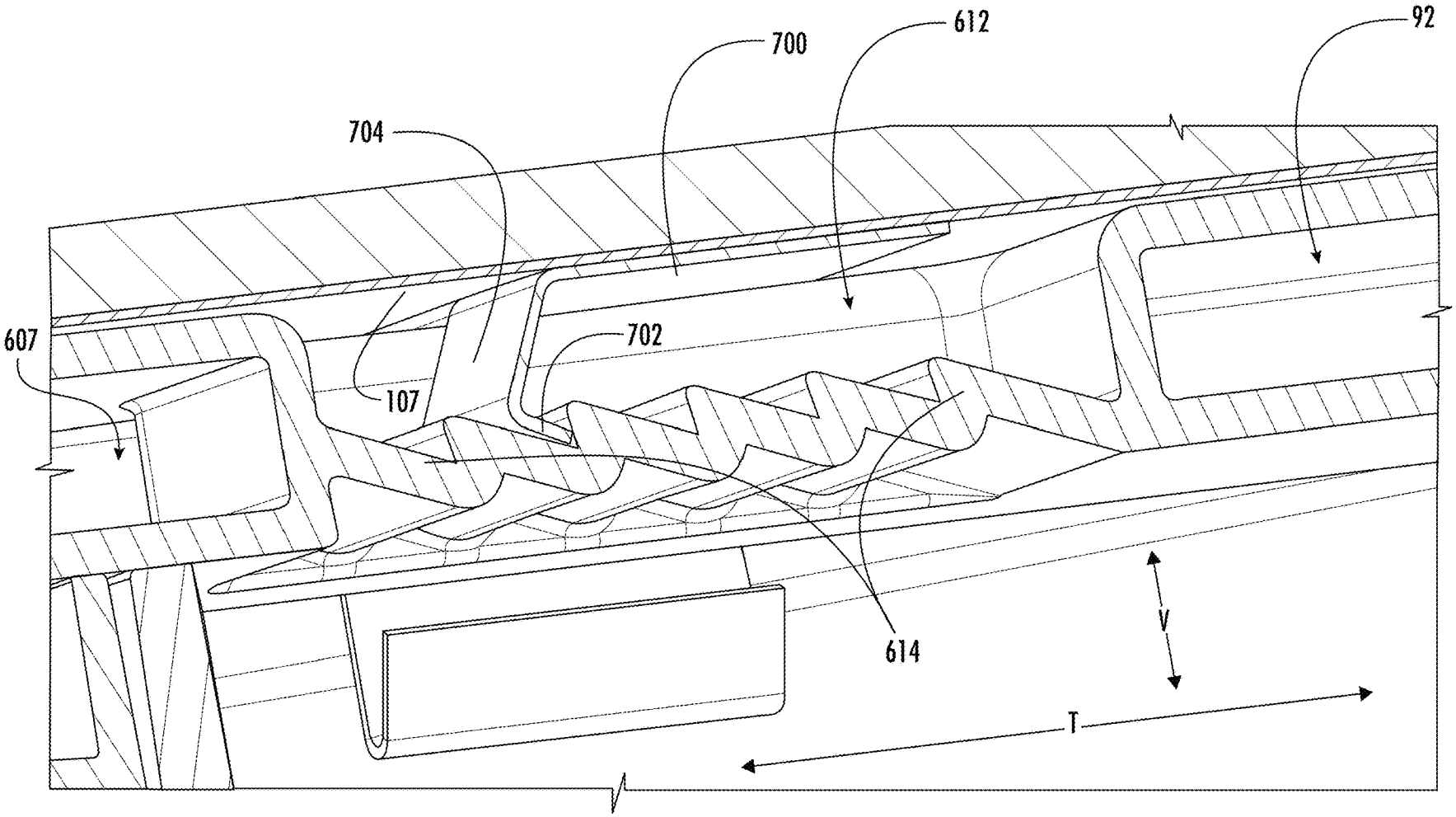
FIG. 8 provides a side perspective view of the retainer portion of the wash conduit of FIG. 7.

Shown in FIGS. 6-8 is an example embodiment of wash conduit 154 which may include a retainer portion 610 generally configured to position wash conduit 154 along the inner side of back wall 112 of tub 104. In particular, FIG. 6 illustrates an example wash conduit according to example embodiments of the present disclosure. In particular, wash conduit 154 may include a wash conduit inlet 600 fluidly coupled to fluid diverter assembly 156. Wash conduit inlet 600 may include a first supply channel inlet 602 and a second supply channel inlet 604. In particular, first supply channel 400 may include first supply channel inlet 602, and first supply channel 400 may generally extend between diverter assembly 156, e.g., first supply channel inlet 602 fluidly couples to diverter assembly 156, and first wash conduit outlet 402. Furthermore, second supply channel 92 may include second supply channel inlet 604. In general, second supply channel 92 may include a second wash conduit outlet 404 and a third (upper) wash conduit outlet 606 (FIG. 7), e.g., second supply channel 92 may generally extend between diverter assembly 156, second wash conduit outlet 404, and third wash conduit outlet 606. For example, second wash conduit outlet 404 may fluidly couple with mid-level spray assembly 140, e.g., to supply water to mid-level spray assembly 140, and third wash conduit outlet 606 may fluidly couple with upper spray assembly 142, e.g., to supply water to upper spray assembly 142. As such, second supply channel 92 may generally extend between diverter assembly 156 and upper spray assembly 142.

As generally seen in FIG. 6, on a top side 608 of wash conduit 154 may be a retainer portion 610 generally configured to position wash conduit 154 along the inner side of back wall 112 of tub 104, as will be described herein below with specific reference to FIGS. 7 and 8. Referring briefly to FIG. 8, a clip 700 may be coupled to the inner side of top wall 107. In general, clip 700 may be welded to the inner side of top wall 107 of tub 104. Clip 700 may generally include a bent portion 704 extending downward from top wall 107 of tub 104 and into retainer portion 610 of wash conduit 154. Additionally, clip 700 may include a hook end 702 at a distal end of bent portion 704 from clip 700. In general, bent portion 704 of clip 700 may be flexible, such that bent portion 704 may flex as wash conduit 154 is installed in tub 104. In particular, when installed in dishwasher appliance 100, wash conduit 154 may be positioned along the inner side of back wall 112 of tub 104 by clip 700, e.g., hook end 702 of bent portion 704, engaging retainer portion 610 of wash conduit 154, such that hook end 702 of bent portion 704 locks wash conduit 154 into position. For example, retainer portion 610 may be configured to engage clip 700 in order to position wash conduit 154 in contact (FIG. 2) with the inner side of back wall 112 of tub 104. In particular, clip 700 may allow wash conduit 154 to be installed in one direction along the transverse direction T, such as in an inward direction towards the back wall 112, and clip 700 may prevent wash conduit 154 from moving in the opposite direction, e.g., outward, along the transverse direction T. Details pertaining to locking wash conduit 154 into position will be further described hereinbelow. As may be seen in FIG. 6, wash conduit 154 may generally include one or more of a side pathway 607 around retainer portion 610, e.g., side pathway 607 may be on either side or both sides of retainer portion 610. For example, water flowing to upper spray assembly 142 through second supply channel 92 may flow through side pathway 607, around retainer portion 610 of wash conduit 154, and through the upper outlet, e.g., third wash conduit outlet 606.

Referring now to FIG. 7, retainer portion 610 of wash conduit 154 may include a stepped interface 612 generally configured to engage with clip 700 on the inner side of top wall 107 of tub 104. In general, stepped interface 612 may include a plurality of angled steps 614, e.g., each step of the plurality of angled steps 614, along the transverse direction T, may vary in height with respect to the vertical direction V. For example, clip 700 may be configured to engage a respective angled step of the plurality of steps 614 of the stepped interface 612 when wash conduit 154 is mounted within wash chamber 106 of dishwasher appliance 100. In general, retainer portion 610 of wash conduit 154 may be rectangular in shape, defined by a length L (FIG. 7) and a width W (FIG. 6). For example, retainer portion 610 of wash conduit 154 may be between one centimeter (1 cm) and seven centimeters (7 cm), such as between two centimeters (2 cm) and six centimeters (6 cm), such as between three centimeters (3 cm) and five centimeters (5 cm) along length L of retainer portion 610. Further, retainer portion 610 of wash conduit 154 may be between half a centimeter (0.5 cm) and four and a half (4.5 centimeters), such as between one centimeter (1 cm) and three centimeters (3 cm), such as between one and a half centimeter (1.5 cm) and two and a half (2.5 centimeters) along width W of retainer portion 610. While retainer portion 610 is described in terms of a rectangular shape of length L and width W in the present example embodiment, one of skill in the art would understand that the rectangular shape is provided by way of example only and retainer portion 610 may be any other suitable shape or size.

As may be seen in FIG. 8, in particular, to lock wash conduit 154 into position, e.g., along the inner side of back wall 112 of tub 104, within dishwasher appliance 100, hook end 702 of clip 700 may be configured to wedge into the respective angled step of the plurality of steps 614 of stepped interface 612, e.g., hook end 702 may be biased into the respective angled step of the plurality of steps 614 by bent portion 704 of clip 700. In the present example embodiment, the respective angled step of the plurality of steps 614 that hook end 702 of clip 700 wedges into depends upon which step of the plurality of steps 614 influences wash conduit 154 to be positioned in contact with the inner side of back wall 112 of tub 104.

As may be seen from the above, a wash conduit of a dishwasher appliance may be adjustably installed to the back of a dishwasher tub. The conduit top may include an adjustable retainer portion with a stepped interface that engages against a flexible metal arm on a top side of the tub. Installing the conduit along the transverse direction allows the metal arm to flex as the conduit pushes towards the back of tub, and the metal arm locks into the steps if the conduit is urged forward. The retainer portion advantageously allows proper positioning of the conduit without the use of screws and screw bosses.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising, a tub comprising a top wall and a back wall, the tub defining a wash chamber;

a diverter assembly at a bottom of the wash chamber;

an upper spray assembly positioned proximate the top wall to the tub and configured to direct wash fluid downward into the wash chamber; and a wash conduit in the wash chamber, the wash conduit comprising:

a first supply channel comprising a first supply channel inlet, the first supply channel extending between the diverter assembly and a wash conduit outlet;

a second supply channel comprising a second supply channel inlet, the second supply channel extending between the diverter assembly and the upper spray assembly; and a retainer portion on a top side of the wash conduit, the retainer portion configured to engage a clip on an inner side of the top wall of the tub in order to position the wash conduit in contact with the back wall of the tub, the upper spray assembly coupled to an upper outlet of the wash conduit.

2. The dishwasher appliance of claim 1, wherein the retainer portion of the wash conduit comprises a stepped interface, the stepped interface configured to engage the clip.

3. The dishwasher appliance of claim 2, wherein the stepped interface comprises a plurality of angled steps, the clip on the inner side of the top wall of the tub configured to engage an angled step of the plurality of angled steps of the stepped interface when the wash conduit is mounted within the wash chamber of the dishwasher appliance.

4. The dishwasher appliance of claim 3, wherein the clip on the inner side of the top wall of the tub comprises a hook end configured to wedge into a respective angled step of the plurality of steps of the stepped interface.

5. The dishwasher appliance of claim 1, wherein water flowing to the upper spray assembly through the second supply channel flows through a side pathway around the retainer portion of the wash conduit.

6. The dishwasher appliance of claim 1, wherein the clip on the inner side of the top wall of the tub extends downward from the inner side of the top wall of the tub and into the retainer portion of the wash conduit.

7. The dishwasher appliance of claim 1, wherein the clip on the inner side of the top wall of the tub is welded to the inner side of the top wall of the tub.

8. The dishwasher appliance of claim 1, wherein the retainer portion of the wash conduit is between two centimeters and six centimeters along a length of the retainer portion, and between one centimeter and three centimeters along a width of retainer portion.

9. The dishwasher appliance of claim 1, wherein, when installed in the dishwasher appliance, the wash conduit is positioned along the inner side of the back wall of the tub by the clip engaging the retainer portion of the wash conduit, such that the wash conduit locks into position.

10. A dishwasher appliance, comprising, a tub comprising a top wall and a back wall, the tub defining a wash chamber;

a diverter assembly at a bottom of the wash chamber;

an upper spray assembly positioned proximate the top wall to the tub and configured to direct wash fluid downward into the wash chamber; and a wash conduit in the wash chamber, the wash conduit comprising:

a supply channel extending between the diverter assembly and the upper spray assembly; and a retainer portion on a top side of the wash conduit, the retainer portion configured to engage a clip on the top wall of the tub in order to position the wash conduit in contact with the back wall of the tub.

11. The dishwasher appliance of claim 10, wherein the upper spray assembly is coupled to an upper outlet of the wash conduit.

12. The dishwasher appliance of claim 11, further comprising a side pathway defined in and through the wash conduit, wherein water flowing to the upper outlet of the wash conduit through the supply channel flows through the side pathway around the retainer portion of the wash conduit.

13. The dishwasher appliance of claim 10, wherein the retainer portion of the wash conduit comprises a stepped interface, the stepped interface configured to engage the clip on the top wall of the tub.

14. The dishwasher appliance of claim 13, wherein the stepped interface comprises a plurality of angled steps, the clip on the inner side of the top wall of the tub configured to engage an angled step of the plurality of steps of the stepped interface when the wash conduit is mounted within the wash chamber of the dishwasher appliance.

15. The dishwasher appliance of claim 14, wherein the clip comprises a hook end configured to wedge into a respective angled step of the plurality of steps of the stepped interface.

16. The dishwasher appliance of claim 10, further comprising a side pathway defined in and through the wash conduit, wherein water flowing to the upper spray assembly through the supply channel flows through the side pathway around the retainer portion of the wash conduit.

17. The dishwasher appliance of claim 10, wherein the clip extends downward from the inner side of the top wall of the tub and into the retainer portion of the wash conduit.

18. The dishwasher appliance of claim 10, wherein the clip is welded to the inner side of the top wall of the tub.

19. The dishwasher appliance of claim 10, wherein the retainer portion of the wash conduit is between two centimeters and six centimeters along a length of the retainer portion, and between one centimeter and three centimeters along a width of the retainer portion.

20. The dishwasher appliance of claim 10, wherein, when installed in the dishwasher appliance, the wash conduit is positioned along the inner side of the back wall of the tub by the clip engaging the retainer portion of the wash conduit, such that the wash conduit locks into position.

* * * * *